United States Patent [19]

Cryderman

[11] Patent Number: 4,726,502

[45] Date of Patent: Feb. 23, 1988

[54] APPARATUS FOR ENTRAINING AND DIRECTING A WET PAPER WEB

[76] Inventor: Gary G. Cryderman, 1704 N. Victor Street, Vickers Heights, Ontario, Canada, P0T 2Z0

[21] Appl. No.: 882,550

[22] Filed: Jul. 7, 1986

[51] Int. Cl.[4] ..... B65H 20/14; D21F 1/42

[52] U.S. Cl. ..... 226/97; 162/193

[58] Field of Search ..... 226/97, 197, 196; 34/156, 160; 162/193, 283, 286

[56] References Cited

U.S. PATENT DOCUMENTS

| | | | |
|---|---|---|---|
| 3,999,696 | 12/1976 | Reba et al. | 226/97 X |
| 4,014,487 | 3/1977 | Reba et al. | 226/97 X |
| 4,136,808 | 1/1979 | Reba | 226/97 X |
| 4,147,287 | 4/1979 | Reba | 226/97 X |
| 4,186,860 | 2/1980 | Reba | 226/97 X |

FOREIGN PATENT DOCUMENTS

| | | | |
|---|---|---|---|
| 2146303 | 4/1985 | United Kingdom | 226/97 |

*Primary Examiner*—Stuart S. Levy
*Assistant Examiner*—Lynn M. Sohacki
*Attorney, Agent, or Firm*—Stanley G. Ade; Adrian D. Battison

[57] ABSTRACT

Apparatus for entraining and directing a wet paper web in a paper making process comprises a wall or plate defining an airfoil section and planar directing section. A curved wall wrapped around the airfoil section defining there between a narrow channel terminating in a mouth of a slot forms an air passage for direction of air over the airfoil section toward the directing section to form a force under the Coanda effect. Three jet nozzles are arranged respectively at ends of the slot and centrally of the slot for directing the web from a roller toward the Coanda effect. The curved surface terminates at a position forwardly of the center line of the airfoil section so as to reduce the angle through which the air turns in the Coanda effect and thus develop a gentle force. The slot is wider at the center than at the sides to develop a greater force at the center.

6 Claims, 4 Drawing Figures

APPARATUS FOR ENTRAINING AND DIRECTING A WET PAPER WEB

BACKGROUND OF THE INVENTION

This invention relates to apparatus for entraining and directing a wet paper web particularly for use in a paper making process.

In paper making a pulp is laid on a wire or grid to a required thickness and over a width which can be the order of 10 feet. The wire or grid is continually moving pass the point of deposit or laying of the pulp and carries the wet pulp while water is initially drained from the pulp to form a soft very fragile layer which will eventually become the paper. After leaving the wire, the pulp is initially carried around a first roller or granite on which it is squeezed and from which it is transferred in the wide web to a drying zone. The web is carried through the drying zone on rope pulleys arranged at the outside edges of the web with the web suspended across the space between the pulleys.

Subsequent to drying the web can be passed through a number of calendar roller stacks to yet further compress the paper and form effectively the finished product.

In many systems for manufacturing paper in this manner, there are spaces between the various components over which the web must traverse. While the line is running normally this continues without problems in that the web has sufficient continuity in strength to span the space. However should a break occur in the web or upon start up of a shift, it is necessary to feed the web from one position to the next across the space between the various items.

Initially such transfer of the web has been carried out by hand in that a first narrow strip of the web is formed at a roller and is then grasped and manually transferred from a roller to the next position in line. Once the narrow strip is set up and running properly, the narrow strip is gradually increased in width until the whole web is running in the proper manner under the proper tension.

This manual technique is of course very difficult, time consuming and dangerous.

Various devices has therefore been developed to assist the transfer and particularly U.S. Pat. Nos. 3,999,696, 4,014,487, 4,136,808, 4,147,287 and 4,186,860 (Imants Reba, assigned to Crown Zellerbach Corporation) show arrangements of this type which use the Coanda effect developed by an airfoil to entrain and transfer the material over a directional surface to the next position in line. These Patents have resulted in a machine currently available on the market which is used for transfer of the paper web at the dry end of the machine that is after the dryer and the calendar roll stacks where the paper web is relatively strong and easy to control. Attempts have been made to manufacture a product of this type which is suitable for transfer of the web at the wet end of the process or machine where the web is effectively merely a compressed layer of pulp and thus has very little strength. All attempts to date have been unsuccessful and there remains therefore a major requirement for a device of this type which can transfer the paper web at the wet end of the machine.

SUMMARY OF THE INVENTION

According to the invention, therefore, there is provided an apparatus for entraining and directing a wet paper web for use in a paper making process, the apparatus comprising first wall means defining an airfoil surface and a directing surface, said airfoil surface being substantially curved and reducing in curvature from end thereof spaced from said directing surface to an end joined to said directing surface and having a shape in cross section defining an imaginary center line on which centers of curvature are located, said center line lying at an acute angle to the directing surface, a pair of upstanding side walls each arranged on a respective side of the wall means and extending longitudinally of the directing surface, second wall means arranged in closely spaced relation to the first wall means at the airfoil surface so as to defined a slot having a length extending across the airfoil surface, means for feeding compressed gas between the first and second wall means so as to pass through the slot and pass around the airfoil means under the Coanda effect to and along said directing surface, support means for mounting said airfoil surface adjacent a wet paper web to be directed, a air jet means for stripping said wet paper web to be drawn onto said airfoil surface by said Coanda effect, said second wall means being arranged to define said slot at a position on said airfoil surface spaced there around toward said directing surface relative to the intersection between said center line and said surface or a extrapolation thereof, and to define said slot having a width greater than 0.014 inch whereby to generate an airflow which is sufficiently gentle to entrain and transport said web around said airfoil surface without damage thereto.

Such a device, therefore, employs the Coanda effect as proposed and used in various previous Patents in this field but the arrangement has been redesigned to provide the necessary very gentle control over the web so that it can be grasped and transferred without damage.

One important preferable feature of the invention is that the slot is defined by the first and second walls to have a width which is greater at a central area thereof then at the ends so that it provides a greater hold over the paper web at the center whereby the web tends to "cup" for more effective feed into the rope pulleys which grasped the web downstream of the granite. The side walls of the device are then significantly higher than the side walls of previous devices so as to guide the "cupped" web over the under surface of the airfoil and directional wall.

According to a further important preferable feature, an additional air jet is provided centrally of the unit and projecting downwardly generally toward the airfoil surface so as to strip the web from the roller and direct it towards the airfoil. This additional air jet compliments the conventional outside jets which project inwardly from the side walls to lift the web from the granite and commence the transfer to the airfoil.

The width of the unit is preferable the order of 6 inches so it can accommodate simply a narrow web of the order of 4 inches in width. In this case the central air jet incorporates one over there of the outer air jets to control the web since the web is received at some position or other across the wider unit with variations in the position occurring due to the natural variations of manual severing and positioning of the web on the rock granite.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
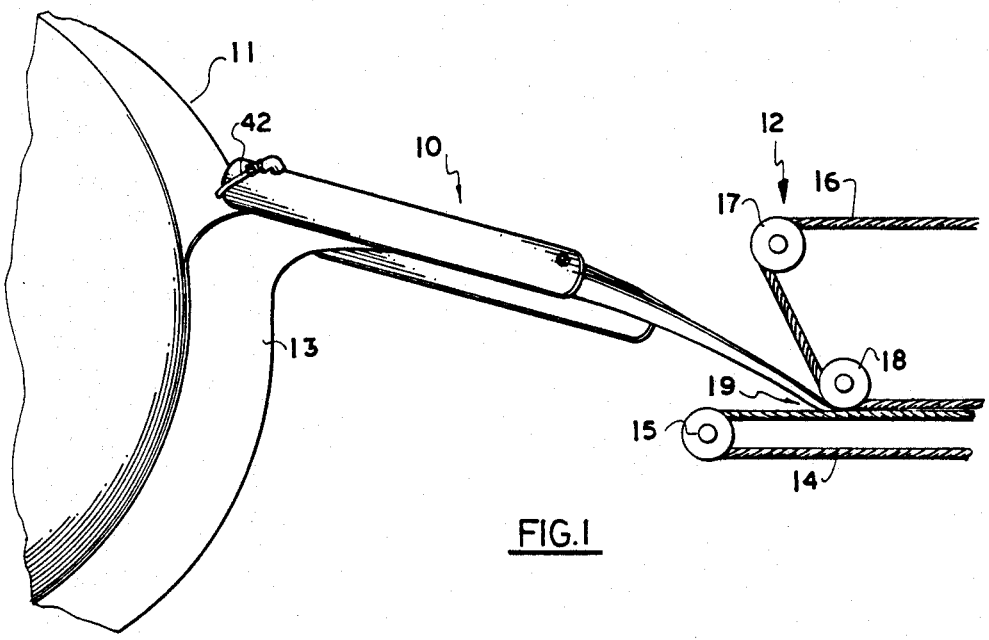
FIG. 1 is an isometric view of the apparatus according to invention positioned between the first granite of wet end of the paper making process and the rope pulleys which transfer the wet web from the granite to the dryer.

The transfer apparatus according to the invention is generally indicated at 10 and is shown in Figure 1 in operation between a granite 11 and a rope pulley system generally indicated at 12. The paper making process in which the apparatus is positioned is of a conventional type and therefore will not be described in detail except to note that the granite or roller 11 is positioned at the wet end of the machine immediately downstream of the wire so that the paper web indicated at 13 is of a very soft pulpy nature having very little strength. The rope pulley system 12 comprises a lower rope 14 carried by and driven by a pulley 15 and a upper rope 16 carried by and driven by a pulley 17 and guided by a pulley 18. Thus the two ropes 14 and 16 generate a rope nip indicated at 19 through which the web is normally carried after being with the drawn from the roller 11.

Two such rope pulley systems are positioned respectively at edges of the web which can be of the order of 10 feet in width. In FIG. 1 is illustrated only a narrow strip of the web which has been manually severed and is fed over the roller 11 to provide a string up or start up piece which can be threaded by apparatus 10 following which the strip 13 is gradually increased in width by manual cutting of the web until the full web is transported across the space between the rope pulley system 12 and the granite 11.

Figure 4:
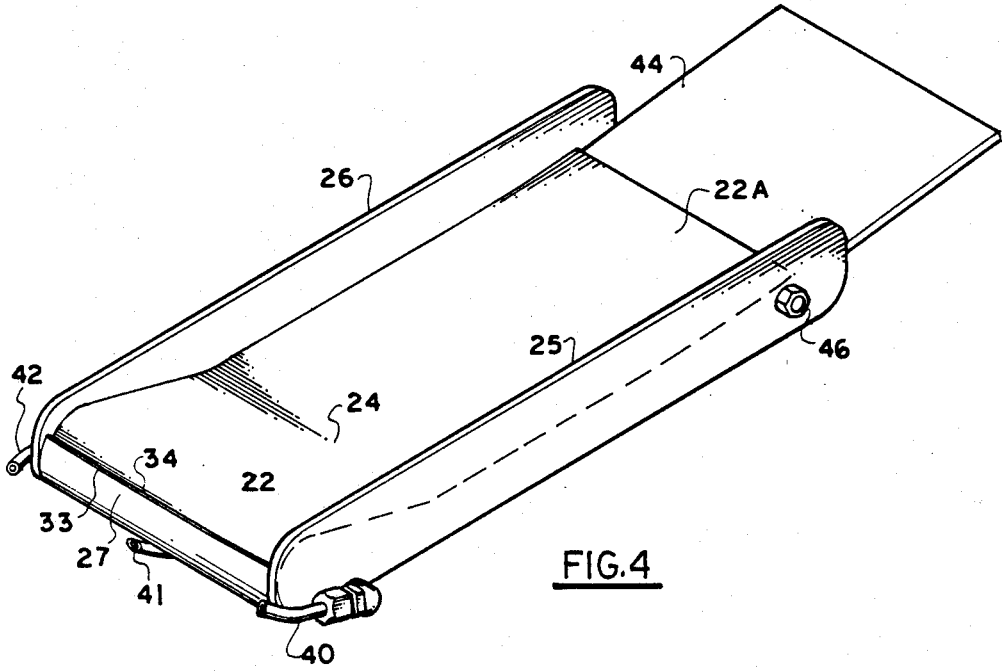
FIG. 4 is an isometric view from underside of the apparatus of FIG. 1.
Figure 2:
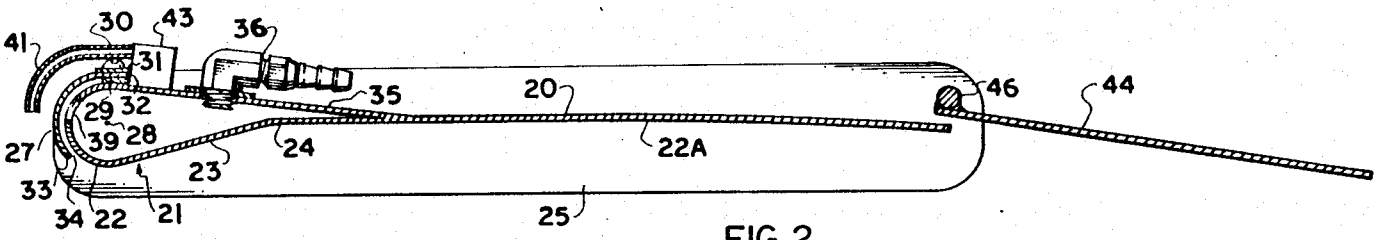
FIG. 2 is a cross sectional view of the apparatus of FIG. 1.
Figure 3:
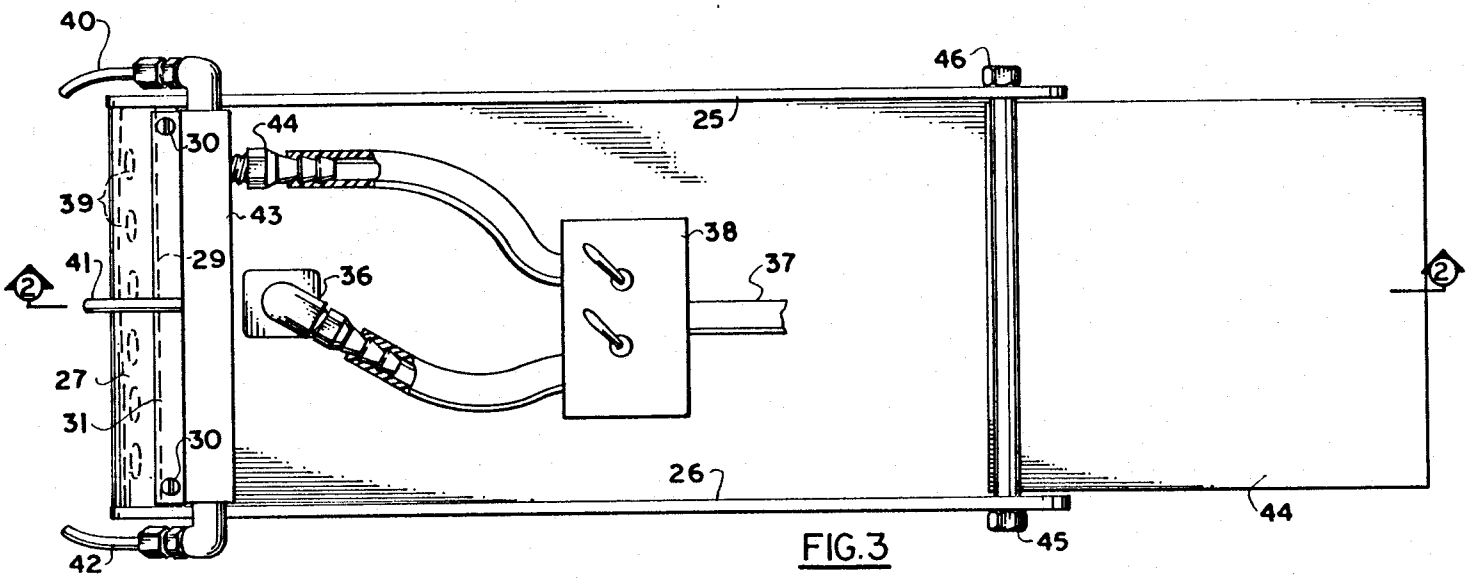
FIG. 3 is a top plan view of the apparatus of FIG. 1.

Turning now to FIGS. 2, 3 and 4 the apparatus is shown in more detail. Specifically the apparatus comprises a first wall member 20 defining an airfoil surface 21 and a directional surface 22A. The airfoil surface 21 comprises a substantially part cylindrical portion 22 and a substantially planar portion 23 thus defining a surface which is initially curved and then reduces in curvature toward a junction 24 between the airfoil surface 21 and the directional surface 22A.

A pair of side walls 25, 26 are attached to edges of the first wall member 20 so that the airfoil surface and the directional surface together with the side walls define a channel through which the web is guided as explained hereinafter.

A second wall member 27 is mounted at the portion 22 of the airfoil surface 21 and has a curvature around a center of curvature indicated at 28 which follows the curvature of the portion 22 which similarly has a center indicated generally at 28. The second wall member 27 is mounted on the first wall member by an elongate block 29 extending across the width of the apparatus with the wall member 27 clamped to the block by screws 30 which pass through a hole in a plate 31 and through slots 32 in the wall member 27. Thus the position of the wall member 27 around the axis 28 can be adjusted by loosening the screws 30 and by sliding the screws within the slots 32 to adjust the end position of the wall member 27 indicated at 33.

The end or nose 33 defines with an adjacent line on the portion 22 a slot 34. The nose 33 is slightly bowed as shown in FIG. 4 so the width of the slot 34 at a central position thereof is wider than the width of the slot adjacent the side walls 25, 26. In one example, the slot width is of the order 0.014 to 0.015 inches adjacent the side walls and of the order 0.018 to 0.022 inches adjacent to the center.

A wall portion 35 connects an upper edge of the airfoil surface 21 to a rear surface of the directional surface 22A to form a closed chamber including the airfoil section. The closed chamber is of course closed at the ends by the side wall 25, 26. An inlet nozzle 36 is positioned in the upper wall 35 so that air from a compressed air source schematically indicated at 37 can be supplied to the chamber under a controlled pressure. The air from the source 37 is controlled by a valve mechanism schematically indicated at 38. The portion of the wall 21 under the wall 27 has a plurality of holes 39 so that air within the closed chamber can escape into an area defined under the wall 27 and closed by the block 29 so that it is forced out from the slot 34. The close confines defining a path of substantially constant curved cross section between the walls 22 and 27 causes the air to closely follow th curved contour of the surface 22 under the Coanda effect which is a well known physical principle and therefore will not be described in detail here.

Three air jet nozzles 40, 41 and 42 are collected to a central manifold 43. The manifold includes an airline coupling 44 for receiving air from the source 37 via the valve 38 for communication through the air jet nozzles.

The air jet nozzles 40 and 42 are arranged at opposite ends of the slot 34 that is at the side walls 25, 26 and are inclined inwardly and downwardly from the manifold 43 on top of the surface 35 as shown best in FIG. 2.

The nozzle 41 is curved around the upper portion of the wall 27 and projects downwardly toward the slot 34 from a position centrally of the manifold 43. Thus the air jet nozzles 40, 41 and 42 will act to direct the web toward the area of the nozzle 34 and the Coanda effect generated thereby.

A planar simple flap without side walls and indicated at 44 is pivotally mounted on the side walls 25 and 26 at the end of the directional surface 22A. The flap is mounted on pivot mountings 45 and 46 so the direction of the flap 44 can be adjusted to further control the direction of the web flowing over the directional surface 22A and subsequently the flap 44.

As shown particularly in FIG. 2, it will be noted that a line of symmetry or substantial symmetry of the airfoil section 22 passes through the center 28 and intersects the junction 24 between the directional surface 22A and the planar portion 23 of the airfoil section. This line of symmetry intersects the airfoil surface portion 22 at a position upstream of the mouth of the slot 34 so the slot 34 is advanced by angle of the order of 45° and lying generally in the range 35° to 60°.

The angular extent of the portion 22 between the mouth of slot 34 and the planar portion 23 is arranged to be relatively small and in one example, this can be of the order of 60° since the angle between the portion 23 and the horizontal is of the order of 15° of the order of 15° that is the angle between the portion 23 and the surface 22A is 165°. This produces a relatively low Coanda effect which is sufficient to entrain and direct the web but insufficient to cause damage to the web by violent forces drawing it against the surfaces. The junction 24 is provided by a gentle smooth curve between the surfaces so that any sharp changes in direction of the web are avoided.

The width of the surfaces between the side walls 25 and 26 is the order of 6 inches and the height of the side walls above the surfaces is of the order of 1.5 inch and no less than 1 inch.

In operation the valve 38 is initially actuated to direct compressed air from the source 37 through coupling 36 to commence the flow of air through the slot 34 in the Coanda effect over the surface. The apparatus is then positioned manually or by a support (not shown) with the surface 22A substantially horizontal and facing downwardly and with the wall 27 projecting toward the web on the roller 11. The air jets 40, 41 and 42 are then actuated by the valve 38 so that the jets tend to direct air beneath the web to lift it from the roller and then view of its great fragility to break the lifted web and project it downwardly and inwardly toward the Coanda effect generated by the slot 34.

The variation of the width of the slot causes a greater Coanda effect at the center of the slot thus closely drawing the center of the web toward the undersurface 22A and applying less force to the edges of the web so that it can hang down in "cupped" shape between the side walls and adjacent the surface 22A for direction toward the rope pulleys support system 12. When transfer is complete, the apparatus can be deactuated by operating the valve 38 and the web taken up in its normal tensioned manner between the system 12 and the roller 13.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An apparatus for entraining and directing a wet paper web for use in a paper making process, the apparatus comprising first wall means having a width of the order of six inches and defining a curved airfoil surface having a center of curvature and a substantially planar directing surface, said airfoil surface being substantially curved and reducing a curvature from one end thereof spaced from said directing surface to an end joined to said directing surface, a pair of upstanding side walls each arranged at a respective edge of the wall means spaced by said width thereof and extending longitudinally of the directing surface, second wall means arranged in closely spaced relation to the first wall means at the airfoil surface so as to define a slot having a length extending across said width of the airfoil surface and a width at a position thereon adjacent said side walls of the order of 0.014 inch and a width at a central position thereon of the order of 0.018 to 0.022 inch, means for feeding compressed gas between the first and second wall means so as to pass through the slot and pass around the airfoil means under the Coanda effect to and along said directing surface, support means for mounting said airfoil surface adjacent a wet paper web to be directed, air jet means comprising three separate jet nozzles arranged at an end of said airfoil surface remote from said directing surface, one of said nozzles arranged adjacent one of said side walls, a second of said nozzles arranged adjacent an opposed one of said side walls and a third of said nozzles arranged intermediate said one and said second nozzles, said nozzles being arranged for stripping said wet paper web to be drawn onto said airfoil surface by said Coanda effect, said second wall means being arranged to define said slot at a position on said airfoil surface spaced there around toward said directing surface relative to an intersection between a line of symmetry of the air foil, which passes through the center of curvature of the air foil, and said airfoil surface.

2. The invention according to claim 1 wherein an angular extent between said intersection and said position on said airfoil surface is arranged to be of the order of 45°.

3. The invention according to claim 1 wherein said airfoil surface on an upstream side of said slot has substantially the same radius of curvature as the surface immediately downstream of said slot and wherein said second wall means defines a surface parallel to said upstream portion, spaced therefrom and following the curvature thereof.

4. The invention according to claim 1 wherein said airfoil surface includes a curved portion adjacent the slot and a substantially planar portion adjacent said directing surface, the angle between said planar portion and said directing surface being of the order of 165°.

5. The invention according to claim 1 wherein said side walls have a height projecting substantially at right angles to said directing surface which is at least 1 inch.

6. The invention according to claim 1 including means defining a further surface pivotally movable relative to said directing surface about an axis at an end of said directing surface remote from said airfoil surface whereby said further surface can redirect said web from said directing surface.

* * * * *